US005673013A

United States Patent [19]

Moody et al.

[11] Patent Number: 5,673,013

[45] Date of Patent: Sep. 30, 1997

[54] BOBBIN CONCENTRICALLY SUPPORTING MULTIPLE ELECTRICAL COILS

[75] Inventors: John W. Moody, Clarkston; Charles Withey, Waterford, both of Mich.

[73] Assignee: Pontiac Coil, Inc., Waterford, Mich.

[21] Appl. No.: 539,967

[22] Filed: Oct. 6, 1995

[51] Int. Cl.[6] ..... H01F 15/10; H01F 27/30

[52] U.S. Cl. ..... 336/192; 336/198; 336/208

[58] Field of Search ..... 310/194; 335/299; 336/198, 208, 192

[56] References Cited

U.S. PATENT DOCUMENTS

| | | | |
|---|---|---|---|
| 4,086,518 | 4/1978 | Wilkinson | 318/127 |
| 4,257,027 | 3/1981 | Yasuhisa | 336/192 |
| 4,514,712 | 4/1985 | McDougal | 336/198 |
| 4,787,823 | 11/1988 | Hultman | 417/45 |
| 4,857,877 | 8/1989 | Dethienne | 336/170 |
| 4,857,878 | 8/1989 | Eng, Jr. et al. | 336/192 |

*Primary Examiner*—Thomas J. Kozma
*Attorney, Agent, or Firm*—Young & Basile, P.C.

[57] ABSTRACT

A bobbin assembly provides means for mounting two coils in concentric relationship with one another for use in electrical devices such as solenoids, relays, and transformers. The bobbin assembly comprises inner and outer hollow, cylindrical spools each having a coil of wire wound thereon prior to being assembled with one another by moving the inner spool into the hollow interior of the outer spool. Alignment members extending axially from the inner and outer spools engage one another to maintain the spools in their concentric relationship and also provide wire guide means routing the ends of the coil wires away from the spools and terminating them in a manner facilitating connection of the coils to associated electric circuits.

14 Claims, 3 Drawing Sheets

10
36
60
53b
38
48
53a
70
18
78
72
16
17
21
34

80
POWER SUPPLY
39
70
78
72
76
17
30
20
60
50
12
31
16
14
18
16

BOBBIN CONCENTRICALLY SUPPORTING MULTIPLE ELECTRICAL COILS

FIELD OF THE INVENTION

The present invention relates in general to electrical devices, such as solenoids, relays and transformers, having two or more concentrically disposed, magnetically coupled coils, and in particular to a bobbin assembly for maintaining the two coils in concentric and electrically isolated relationship with one another.

BACKGROUND OF INVENTION

Certain electrical devices include as components two or more coils of electrically conductive wire mounted in concentric relationship with one another. One example is a solenoid having a driving coil and an armature position sensing coil concentrically mounted on a common coil form. Such a solenoid can be used for various purposes, including use as the motive power source in a diaphragm type fuel pump.

The driving coil is energized to create an electromagnetic field causing movement of a ferrous armature, and the armature movement induces an electric current in the sensing coil. The induced current is used as an input to a circuit which cuts off the supply of current to the driving coil, and a spring returns the armature to its starting position.

The wire sizes used to form the driving and sensing coils are quite different, with heavy gauge wire required in the driving coil and a relatively fine gauge required in the sensing coil. Moreover, the finer wire of the sensing coil is usually wound over the top of the heavier driving coil on its same coil winding form or spool. The two coils are typically isolated electrically by a varnish-like wire coating and by a thin layer of tape wrapped around the outer surface of the driving coil. The sensing coil is wound directly on top of the tape, and the thin layer of tape separating the two coils does not provide a smooth surface on which to wind the sensing coil.

Accordingly, a number of problems result from the fine wire of the sensing coil being wound on top of the irregular surface provided by the heavier gauge driving coil wire. Among these problems are difficulty in achieving an even distribution of sensing coil wire over the length of the driving coil, and an often unacceptable percentage of product failure due to the breakage of the fine sensing wire during the coil winding process.

SUMMARY OF THE INVENTION

This invention is directed to the provision of a bobbin assembly for mounting two coils of electrically conductive wire in concentric relationship with one another. The invention bobbin assembly is adapted for efficient mass production of concentric coil bobbins, and provides a means for conveniently terminating the ends of the coil wires whereby they may be connected to their associated electrical circuits.

The assembly comprises an outer bobbin for mounting a first coil and an inner bobbin for mounting a second coil, with each bobbin having an alignment member extending parallel to the winding axis and radially spaced from the winding axis. The alignment members are located so as to come into engagement with each other as the inner bobbin is moved axially into the outer bobbin and act to maintain the bobbins in concentric alignment.

The alignment members include wire guide means for routing the opposite ends of the coil wires longitudinally away from the bobbins and terminating the wire ends in fixed positions to facilitate the connection of the coils to their respective circuits.

To manufacture the invention bobbin assembly, the inner and outer bobbins each have their respective coils wound about them prior to assembly with one another, with the wire ends routed along and in the wire guides and terminated at the ends of the alignment members distal from the bobbins. The two bobbins are than placed in coaxial alignment with one another and moved toward each other along the mutual axis to position the inner bobbin within the interior of the outer bobbin. As the bobbins are moved together, the alignment members engage each other to guide the bobbins into their proper concentric relationship.

The invention bobbin assembly may be efficiently manufactured due to the elimination of the need to wind the outer coil around a previously wound inner coil, and due to the provision of alignment members which position and terminate the ends of the coil wires in addition to guiding and maintaining the bobbins in proper concentric relationship.

DETAILED DESCRIPTION OF THE PREFERRED EMBODIMENT

Figure 1:
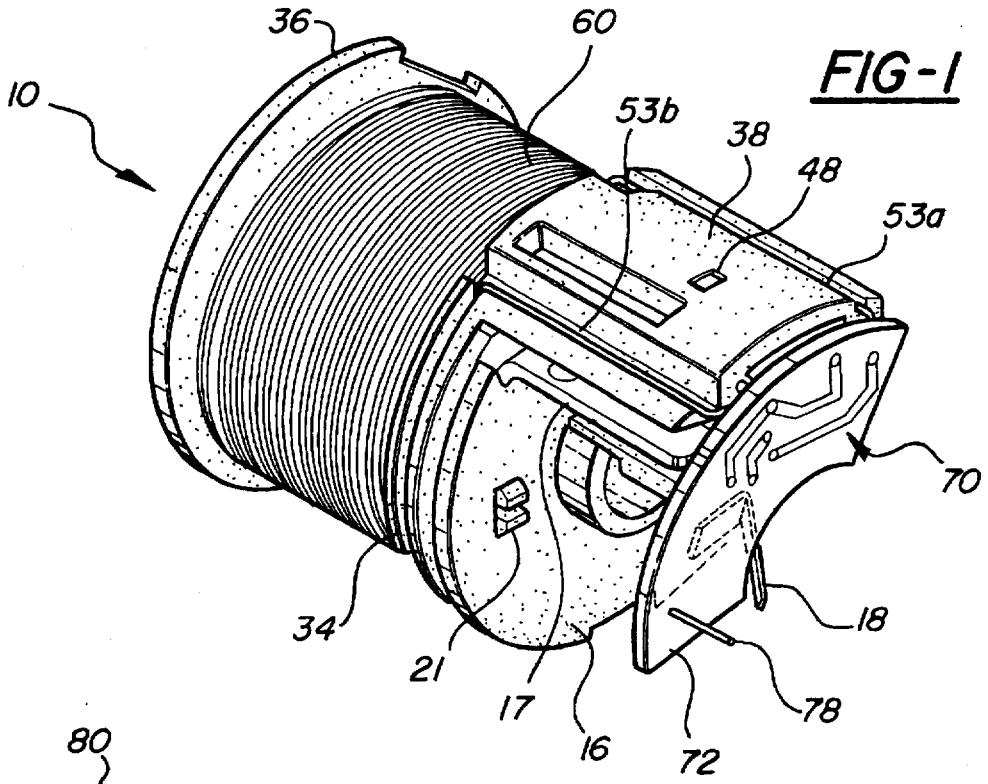
FIG. 1 is a perspective view of the invention bobbin assembly.

FIG. 1 shows a bobbin assembly 10 for a solenoid such as is used in an automotive vehicle fuel pump. In such a fuel pump, an armature 12 (see FIG. 2) made of a ferrous material such as iron is retained for sliding axial movement inside of a bushing 31 positioned in the hollow interior of bobbin assembly 10. Armature 12 is connected to a diaphragm element 14, reciprocating motion of which supplies fuel to a vehicle engine (not shown).

In a manner known in the art, a driving coil 50 of electrically conductive wire surrounds armature 12 and is supplied with direct current by a power supply 80. The energized coil 50 creates an electromagnetic field which drives armature 12 to the left as viewed in FIG. 2, while a spring 16 applies a force to the armature to move it to the right when the coil is deenergized. A sensing coil 60 concentrically surrounds driving coil 50, and energization of the driving coil and the resulting motion of the armature induce an electrical current in the sensing coil, the magnitude and/or phase of the induced current being a function of the longitudinal position of the armature relative to the coil centers. The current induced in sensing coil 60 is used as an input to a control circuit, generally indicated at 70 and including a transistor 76, formed on a printed circuit board 72. Control circuit 70 serves, in a manner known to those skilled in the art, to alternatingly energize and deenergize drive coil 50 based on the position of armature 12 as indicated by the current induced in sensing coil 60, thus causing armature 12 to continuously reciprocate. Control circuit 70 also serves to suppress electrical "noise" produced by coils 50, 60 and to protect the coils against reverse voltage conditions. A non-magnetic yet electrically conductive heat sink 16 is attached to the front face of bobbin assembly 10. Heat sink 16 has a forwardly projecting arm 17 electrically connected to printed circuit board 72 and a soldered-on tab 18 providing a connection to ground to complete the electrical circuit.

Bobbin assembly 10 comprises an inner bobbin 20 on which driving coil 50 is wound and an outer bobbin 30 on which sensing coil 60 is wound. Inner and outer bobbins 20, 30 are formed of a rigid, electrically nonconductive and nonmagnetic material such as thermoplastic resin, and coils 50, 60 are electrically conductive wire, preferably copper.

Outer bobbin 30 comprises a hollow cylindrical spool 32, front and rear flanges 34, 36 extending radially from opposite ends of the spool, and an alignment arm 38 attached to the front flange and extending away from the flange in a direction parallel with the winding axis 64 of the bobbin. The surface of spool 32 may be smooth as shown, or alternatively may have circumferential winding grooves formed in its surface to receive the innermost layer of wire constituting coil 60.

An alignment slot 40 is formed along the bottom surface of alignment arm 38, a portion of the end of the slot distal from flange 36 having bevelled inner walls 42 to give the slot a dovetail shape. The upper surface of alignment arm 38 is generally curved to match the outer diameter of front flange 34, and a pair of wire guide channels 35*a*, 35*b* run along the top surface, one on either side of and parallel to alignment slot 40. Conductive pins 39 are mounted firmly in the end of alignment arm 38 adjacent to the ends of wire guide channels 35*a*, 35*b* so as to extend axially therefrom. A detent hole 48 passes through the upper surface of alignment arm 38 between wire guide channels 35*a*, 35*b* and communicates with alignment slot 40.

A circumferential portion of front flange 34 is split into a forward flange wall 34*a* and a rearward flange wall 34*b* to define therebetween a wire guide groove 46. Wire guide groove 46 extends around approximately one quarter of the circumference of front flange 34, the groove having a first end 46*a* adjacent to and in communication with wire guide channel 35*a* and a second end 46*b* in communication with the rear surface of the rearward flange wall 34*b*.

The rear surface of rearward flange wall 34*b* is co-planar with the rear surface of the rest of front flange 34, but since the overall thickness of the split portion of the flange is greater than the thickness of the un-split portion, forward flange wall 34*a* projects slightly farther forward than the front surface of the un-split portion of the flange, thereby creating a forward step 33.

Inner bobbin 20 comprises a hollow cylindrical spool 22, front and rear flanges 24, 26 extending radially from opposite ends of the spool, and an alignment prong 28 attached to the front flange and extending away from the flange in a direction parallel with the winding axis 66 of the bobbin. The surface of spool 22 may be smooth as shown, or alternatively may have circumferential winding grooves formed in its surface to receive the innermost layer of wire constituting coil 50. Two pairs of retaining prongs 21 project from the front surface of front flange 24 at positions diametrically opposite one another.

A pair of wire guide channels 25*a*, 25*b* extend along the upper surface of alignment prong 28. Wire guide channels 25 are parallel with winding axis 66, and conductive pins 29 are mounted firmly in the end of alignment prong 28 adjacent to the ends of wire guide channels 25*a*, 25*b* so as to extend axially therefrom. An upwardly projecting detent finger 54 is formed on the upper surface of alignment prong 28 between wire guide channels 25*a*, 25*b* and the distal end of the alignment prong widens toward the outside of the radius of bobbin 20 to form bevelled edges 37.

Figure 4:
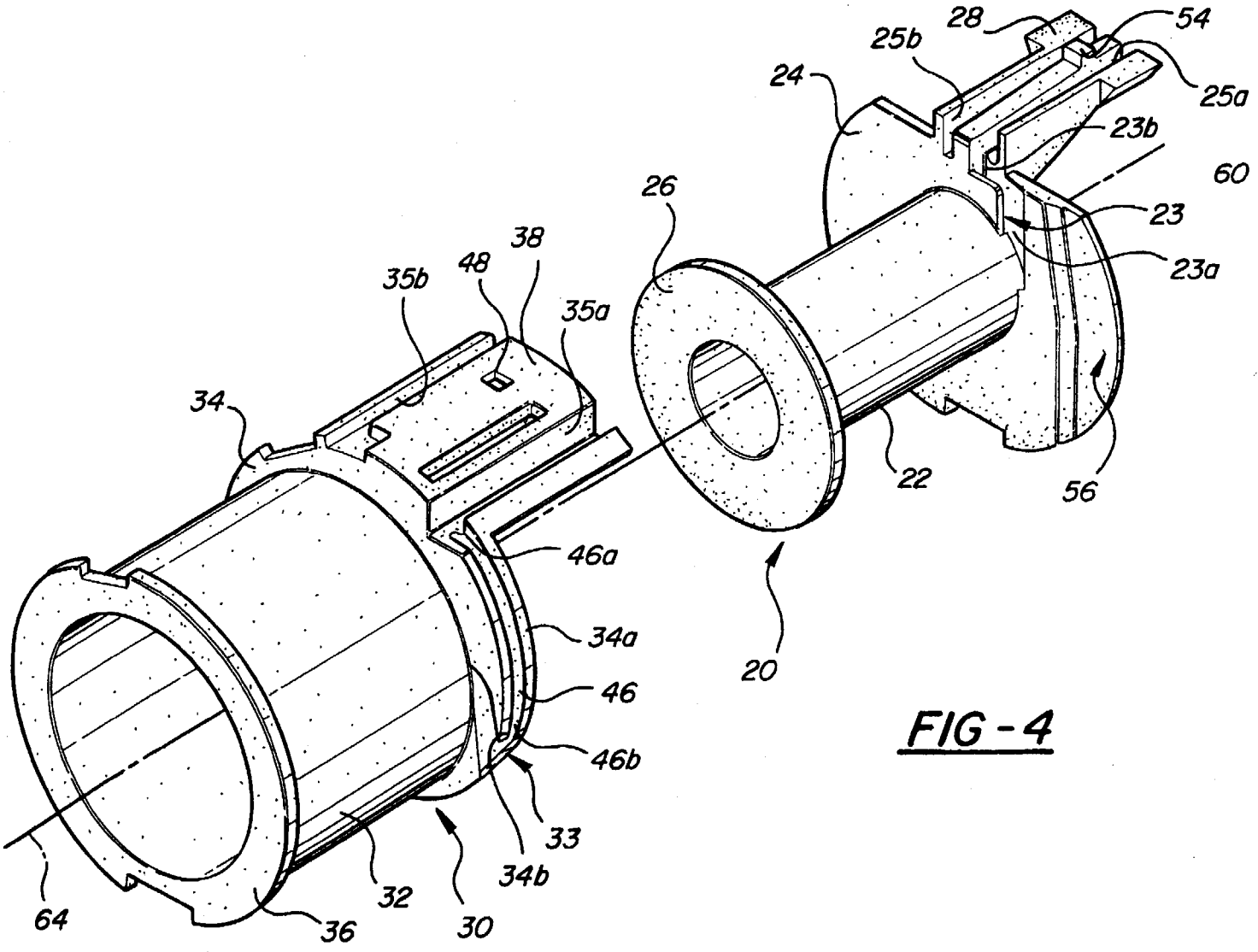
FIG. 4 is a rear exploded perspective view of the inner and outer bobbins of the bobbin assembly of FIG. 1, without coils wound thereon.

As is visible in FIG. 4, a wire guide notch 23 is formed in the rear surface of front flange 24, the notch extending from a first end 23*a* adjacent to and in communication with wire guide channel 25*a* to a second end 23*b* adjacent the juncture between the front flange and spool 22. A relieved area 56 is formed along the rear surface of front flange 24 adjacent the outer circumferential edge thereof.

The inside diameter of outer spool 32 is slightly greater than the outside diameter of inner bobbin rear flange 26, and flanges 24, 34, and 36 are all of substantially the same outside diameter. Bobbins 20 and 30 are preferably made of different colored materials to facilitate differentiation between the two parts during the assembly process described below.

Manufacturing Process

In the manufacture of bobbin assembly 10, driving and sensing coils 50, 60 are first wound on their respective bobbins 20, 30. Spools 22, 32 provide uniform cylindrical winding surfaces on which the initial turns of wire are laid down. Accordingly it is possible to form both the inner and the outer coils very accurately, with the windings of wire being uniform and precisely positioned, and thereby substantially reducing the probability of wire breakage during winding.

Opposite ends of the length of wire making up driving coil 50 are routed to lie in wire guide channels 25*a*, 25*b*, with a first wire end 52*a* extending from the inside of the coil into wire guide notch 23 and then into channel 25*a*, and a second wire end 52*b* extending from the outside of the coil directly into channel 25*b*. Wire ends 52*a*, 52*b* extend out the end of their respective channels and are terminated by being wrapped around and/or soldered to a respective pin 29.

In similar fashion, the ends of the wire which forms sensing coil 60 are routed along guide channels 35, with a first wire end 62*a* extending from the inside of the coil into wire guide groove 46, around the circumference of flange 34, and then into channel 35*a*, and a second wire end 62*b* extending from the outside of the coil directly into channel 35*b*. Wire ends 62*a*, 62*b* extend out the end of their respective channels and are terminated by being wrapped around and/or soldered to a respective pin 39.

It should be noted that wire guide notch 23, wire guide groove 46 and wire guide channels 25*a*, 25*b*, 35*a*, 35*b* are of sufficient width and depth that the coil wires are seated entirely therein, and the wires do not protrude above the tops thereof where they may be damaged by contact with, for example, the fuel pump housing (not shown) during assembly.

Next, the two bobbins 20, 30 are positioned with the winding axes 64, 66 of the coils in coaxial alignment and alignment prong 28 and alignment arm 38 in linear alignment. The bobbins are then moved toward each other along the mutual axis so that the bobbins fit together in a telescoping manner, i.e. inner bobbin rear flange 26 and inner spool 22 slide into the hollow interior of outer bobbin 30 and alignment prong 28 slides simultaneously into alignment slot 40 of alignment arm 38.

Inner and outer bobbins 20, 30 are maintained in concentric alignment with one another by the close fit between the outside diameter of inner bobbin rear flange 26 and the inside diameter of outer spool 32, and by the positive positioning of alignment prong 28 within alignment slot 40 resulting from the interlocking fit between bevelled edges 37 and bevelled inner walls 42. When inner and outer bobbins are fully and properly mated, pins 29, 39 are positioned in a single plane normal to the coincident winding axes 64, 66 of the coils, the rear surfaces of rear flanges 26, 36 are substantially co-planar and the rear surface of front flange 24 is in contact with the front surface of front flange 34, with relieved area 56 receiving forward step 33. Also, detent finger 54 snaps into detent hole 48 to hold bobbins 20, 30 in their mated condition.

Figure 2:
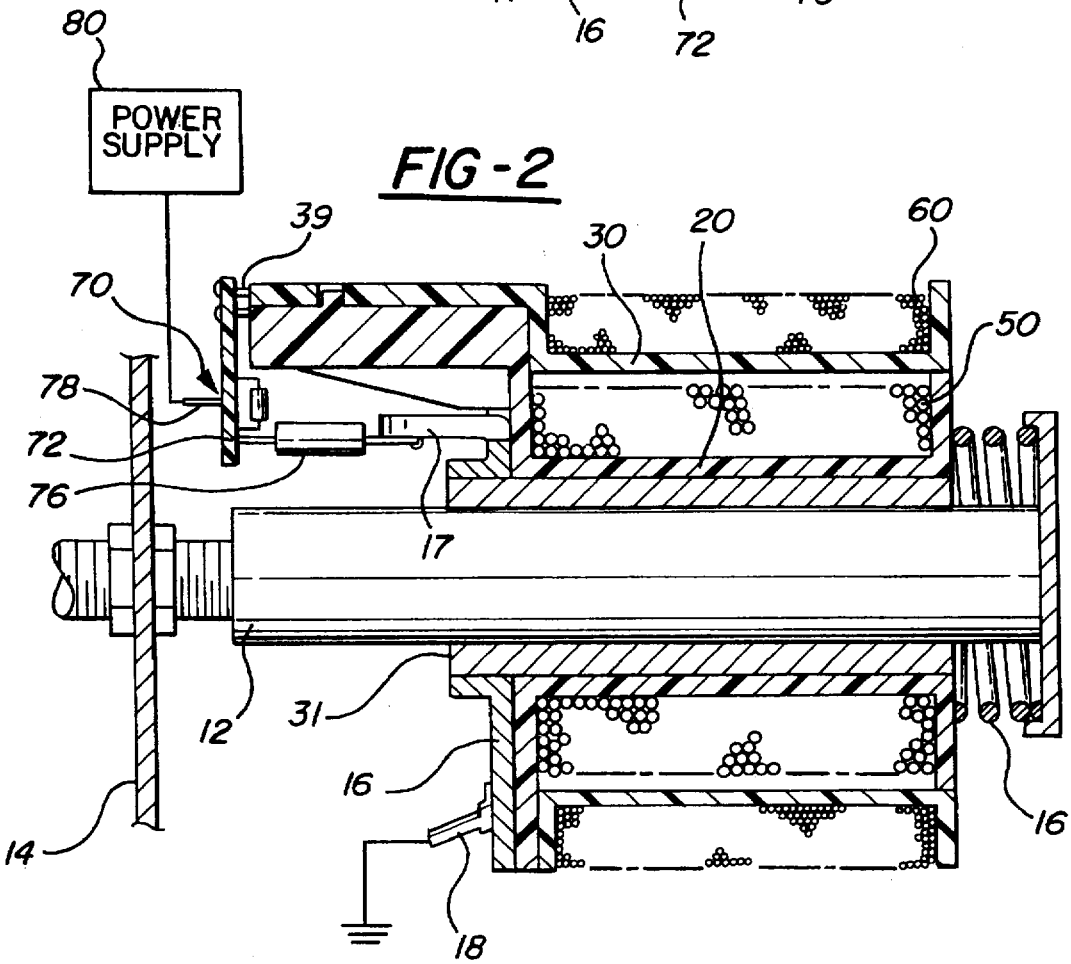
FIG. 2 is a cross-sectional view of the bobbin assembly of FIG. 1 in combination with a solenoid armature.
Figure 3:
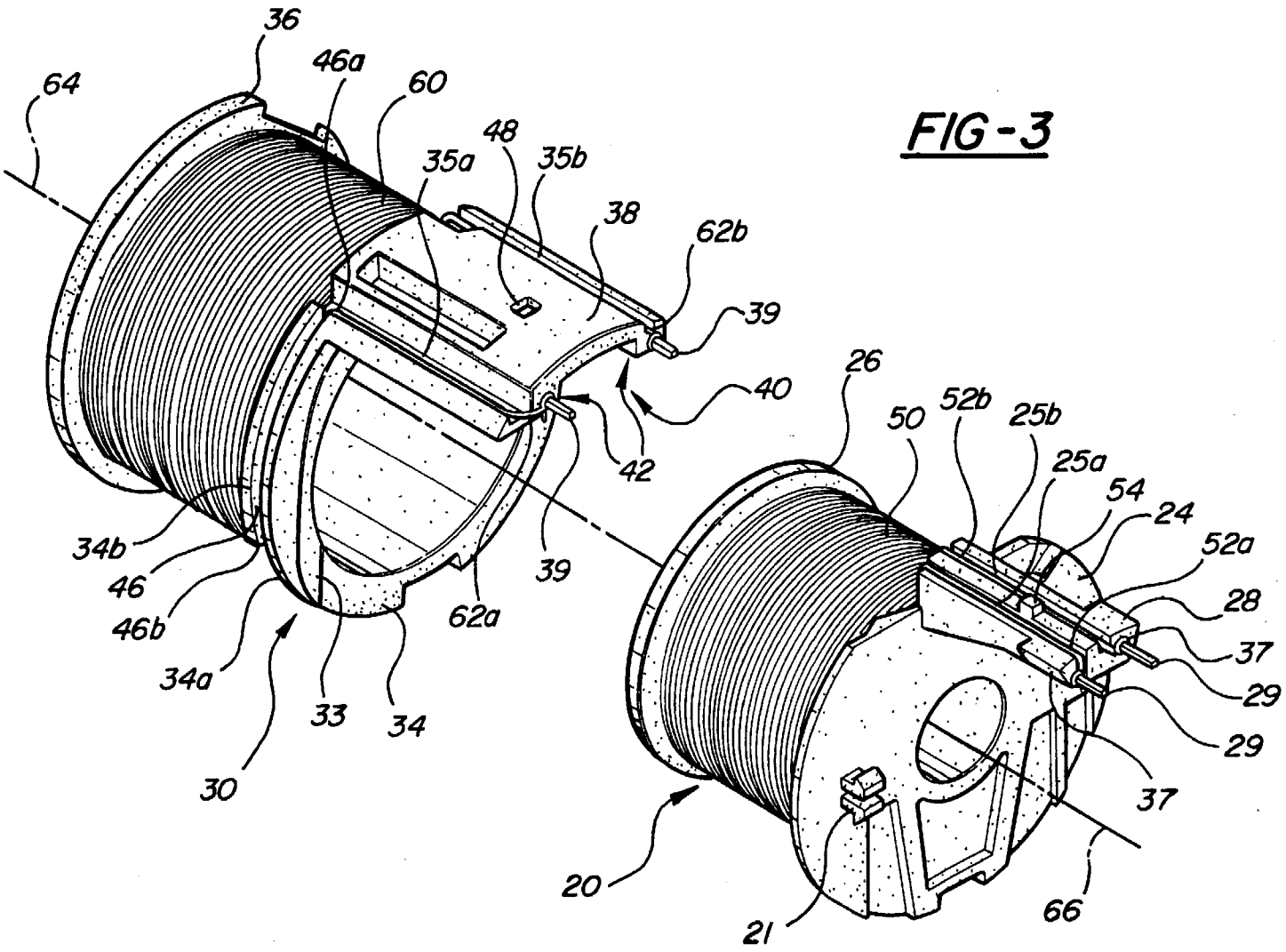
FIG. 3 is a front exploded perspective view of the inner and outer bobbins of the bobbin assembly of FIG. 1, with coils wound thereon.

Heat sink 16 is positioned with mounting holes formed therein over retaining prongs 21 and then pressed over the prongs to retain the heat sink flush with front flange 24 (see FIGS. 1 and 2). Next, printed circuit board 72 is positioned such that mounting holes formed therein are engaged by pins 29, 39 and transistor 76 contacts heat sink arm 17. Pins 29, 39 are soldered into connection with circuit traces 74 and transistor 76 is connected with arm 17 by a rivet and/or solder, thereby mounting the printed circuit board rigidly to bobbin assembly 10 and establishing electrical connection between coils 50, 60 and control circuit 70. A terminal 78 on printed circuit board 72 is connected with power supply 80 and tab 18 on heat sink 16 is connected to ground to complete the electrical circuit.

The invention thus provides a bobbin assembly that may be precisely and efficiently manufactured due to the elimination of the need to wind the outer coil around a previously wound inner coil, and due to the employment of alignment members to position and terminate the ends of the coil wires in addition to guiding and maintaining the bobbins in proper concentric relationship.

It will be appreciated that the drawings and descriptions contained herein are merely meant to illustrate a particular embodiment of the present invention and are not meant to be limitations upon the practice thereof, as numerous variations will occur to persons of skill in the art. For example, although the invention is described above in relation to a solenoid having a driving coil and a sensing coil, it is to be understood that the invention may also be practiced in relation a wide range of electrical devices having multiple concentric coils, such as transformers, relays, or solenoids having two or more concentrically disposed driving coils.

We claim:

1. A bobbin assembly comprising:

a hollow, cylindrical first spool having a uniform cylindrical exterior surface formed about a first winding axis for receiving thereon a first coil of electrically conductive wire;

a first flange extending radially from an end of the first spool;

a first alignment member disposed on the first flange in radially spaced relation to the first winding axis and extending parallel to the first winding axis;

a hollow, cylindrical second spool having a uniform cylindrical exterior surface formed about a second winding axis for receiving a second coil of electrically conductive wire;

a second flange extending radially from an end of the second spool;

a second alignment member disposed on the second flange in radially spaced relation to the second winding axis and extending parallel to the second winding axis and adapted for engagement with the first alignment member when the second spool is disposed in the hollow interior of the first spool;

means associated with the first and second spools for maintaining the spools in fixed, coaxial relationship with the second spool substantially wholly within the hollow interior of the first spool;

the first and second spools being formed of non-magnetic, non-conductive material; and at least one of the alignment members including wire guide means for maintaining opposite ends of the wire of at least one of the coils in fixed positions with respect to the bobbin assembly.

2. A bobbin assembly according to claim 1 wherein the wire guide means comprises channels formed in at least one of the alignment members and adapted to receive the opposite ends of the at least one coil wire therein.

3. A bobbin assembly according to claim 1 wherein at least one of the flanges includes second wire guide means, the second wire guide means having a first end adjacent the juncture between the at least one flange and the attached spool and a second end adjacent to and in communication with the alignment member wire guide means.

4. A bobbin assembly according to claim 3 wherein the second wire guide means comprises a wire guide groove formed in the outer circumferential edge of the at least one flange and extending around at least a portion of the circumference of the at least one flange.

5. A bobbin assembly according to claim 3 wherein the second wire guide means comprises a wire guide notch formed in a surface of the at least one flange.

6. A bobbin assembly for supporting a first coil of electrically conductive wire in surrounding concentric relationship with a second coil of electrically conductive wire, the bobbin assembly comprising:

a hollow outer bobbin comprising a first spool for receiving the first coil, a first flange extending radially outward from an end of the first spool, and a first alignment member extending from the first flange along a path substantially parallel with a longitudinal axis of the first spool; and an inner bobbin comprising a second spool for receiving the second coil, a second flange extending radially outward from an end of the second spool, and a second alignment member extending from the second flange along a path substantially parallel with a longitudinal axis of the second spool, the inner bobbin adapted to be assembled with the outer bobbin by aligning the bobbins coaxially with one another and moving the second spool into a hollow interior of the first spool, the first and second alignment members adapted to engage one another as the second spool is moved into the hollow interior of the first spool, the engagement between the first and second alignment members maintaining the second spool concentrically within the first spool.

7. A bobbin assembly according to claim 6 wherein at least one of the alignment members includes wire guide means for receiving opposite ends of the wire of at least one of the coils and maintaining the ends in fixed positions with respect to the bobbin assembly.

8. A bobbin assembly according to claim 6 wherein at least one of the flanges includes second wire guide means, the second wire guide means having a first end adjacent the juncture between the at least one flange and the attached spool and a second end adjacent to and in communication with the alignment member wire guide means.

9. A bobbin assembly according to claim 8 wherein the second wire guide means comprises a wire guide groove formed in the outer circumferential edge of the at least one flange and extending around at least a portion of the circumference of the at least one flange.

10. A bobbin assembly according to claim 8 wherein the second wire guide means comprises a wire guide notch formed in a surface of the at least one flange.

11. A bobbin assembly for mounting a first coil of wire in concentrically surrounding relationship with a second coil of wire, the bobbin assembly comprising:

an outer bobbin including a tubular outer spool for receiving the first coil thereon and having a first coil winding axis and a hollow interior, a first flange extending radially outward from a first end of the outer spool, a second flange extending radially outward from an opposite second end of the outer spool, and a first alignment member disposed on and extending from the first flange parallel to the first coil winding axis and having wire guide means for receiving and terminating opposite ends of the wire of the first coil; and an inner bobbin including a tubular inner spool for receiving the second coil thereon and having a second coil winding axis, a third flange extending radially outward from a first end of the inner spool, a fourth flange extending radially outward from an opposite second end of the inner spool, and a second alignment member disposed on and extending from the third flange parallel to the second coil winding axis and having wire guide means for receiving and terminating opposite ends of the wire of the second coil, the diameter of the fourth flange being smaller than the diameter of the hollow interior of the outer spool;

the inner and outer bobbins being adapted for assembly with one another by placing the first and second coil winding axes in coaxial alignment and moving the inner spool and fourth flange of the inner bobbin axially into the hollow interior of the outer spool to position the second end of the inner spool concentrically inside the second end of the outer spool and substantially simultaneously moving the first and second alignment members into engagement with one another to position the first end of the inner spool concentrically inside the first end of the outer spool.

12. A bobbin assembly according to claim 11 wherein at least one of the flanges includes second wire guide means, the second wire guide means having a first end adjacent the juncture between the at least one flange and the attached spool and a second end adjacent to and in communication with the alignment member wire guide means.

13. A bobbin assembly according to claim 12 wherein the second wire guide means comprises a wire guide groove formed in the outer circumferential edge of the at least one flange and extending around at least a portion of the circumference of the at least one flange.

14. A bobbin assembly according to claim 12 wherein the second wire guide means comprises a wire guide notch formed in a surface of the at least one flange.

* * * * *